United States Patent [19]

Bode

[11] 4,030,206

[45] June 21, 1977

[54] THRUST GRATE SUCH AS A HEAT EXCHANGE GRATE

[75] Inventor: Herbert Bode, Wohltorf, Germany

[73] Assignee: Claudius Peters AG, Hamburg, Germany

[22] Filed: June 2, 1975

[21] Appl. No.: 582,695

[30] Foreign Application Priority Data

June 7, 1974 Germany ..... 2427684

[52] U.S. Cl. ..... 34/164; 110/38; 432/134

[51] Int. Cl.[2] ..... F26B 9/00

[58] Field of Search ..... 34/164, 236; 432/134, 432/122, 123; 110/38

[56] References Cited

UNITED STATES PATENTS

| | | | |
|---|---|---|---|
| 2,371,513 | 3/1945 | Gaffney | 34/164 |
| 3,010,218 | 11/1961 | Sylvest | 34/164 |
| 3,016,849 | 1/1962 | Markle, Jr. et al. | 110/38 |
| 3,624,920 | 1/1970 | Coutelan | 34/164 |

*Primary Examiner*—Kenneth W. Sprague
*Assistant Examiner*—James C. Yeung
*Attorney, Agent, or Firm*—Otto John Munz

[57] ABSTRACT

A thrust grate, particularly a cooling or fire grate having an essentially horizontal sequence of two sets of grate plates alternatingly fixed and reciprocating forward and backward in linear alignment and vertically spaced from each other. Each set of plates has a rear portion extending in the direction of movement of the movable grate plates, an at least partially upward slanting front portion, and an inclined front.

The front end of each plate overlaps the rear end of each following plate. The front ends of the fixed and reciprocating plates, each, are provided with a lip or nose, respectively, to move the material deposited on the sloped portions thereof.

The angle of the sloped portion of the fixed grate plates is different from that of the movable grate plates.

The rear portion of the plates with the smaller angle is positioned on a higher level than the rear portion of the plates with the larger angle slope.

The combination of the features of the two plates permits a substantially horizontal movement of the thrust grates.

10 Claims, 2 Drawing Figures

THRUST GRATE SUCH AS A HEAT EXCHANGE GRATE

CROSSREFERENCE TO A RELATED APPLICATION

Priority of corresponding German patent application Number P 24 27 684.4, filed June 7, 1974 is claimed under the Convention.

FIELD OF ART

A heat-exchanger grate with means to move the material.

DESCRIPTION OF THE PRIOR ART

The prior art is represented by U.S. Pat. No. 2,846,778 of Aug. 12, 1958 to H. A. Markle, Jr. for a "Horizontal Heat-Exchange Apparatus."

The Markle device has the disadvantage that the material deposited on the grate continuously slides down. This danger exists especially in cooling grates for fine-grained materials which might be loosened up by the cooling air flowing through the grate and the layer from the bottom to the top. A horizontal arrangement of the prior art has the disadvantage that the material must be conveyed over a relatively steep inclination of the fixed grate plate group when a forward thrust of the movable grate plate is employed. In an attempt to correct this disadvantage the direction of movement of the movable grate plates of this type was arranged inclined in an upward slanting as disclosed in U.S. Pat. No. 2,846,778. This improvement, however, suffers with the disadvantage that the grate plate drive, due to the lifting force must deliver at the forward movement a substantially greater power than at a horizontal direction of movement, whereas this power at the backward movement is lower, on account of the weight of the material layer which aids this movement. This power change may result in considerable complications. Plates with larger differences in height normally have a relatively strong inclination in the front plate portion. This results in substantial problems of wear by making the slope rise, with a sudden change of direction from the horizontal rear area of the plate and not in a smooth curvature.

SUMMARY OF THE INVENTION

The objects of the invention are:

to improve upon the prior art;

to provide in the horizontal grate of the type mentioned satisfactory capacities for conveying the material deposited thereon;

to provide in the system described a conveying capacity of the movable grate by means of imparting to it an upwardly slanting shape, while also safely preventing a sliding down of the material deposited on the grate;

to provide the above mentioned improvements by making the angle of the front portion of the fixed grate plates larger than the angle of the front portion of the movable grate plates;

to provide the thrust gate with an essentially horizontal direction of movement;

to provide a different angle of slope of the front portion of the fixed grate plates from the angle of slope of the front portion of the movable grate plates;

to position the rear portion of the plates with a smaller angle of slope on a higher level than the rear portion of the plates with the larger angle of slope;

to make the smaller angle of slope as small as possible, at least smaller than 12°, preferably even smaller, between 5° and a 0° and to make the larger angle of slope larger than 12° and preferably larger than 15°, with particular combinations from 0° to 20°,as well as 8° and 17°, respectively which have proved to be successful;

to provide each of the two plate series with a slanting front portion with an approximately equal front height;

to provide in a plate series with the angle of slope zero or very small the front height in this plate series suitably greater than in the former;

to provide the larger angle of slope on the fixed grate plates and the smaller angle on the movable grate plates;

to prevent safely sliding down of the material layer deposited on the grate;

to provide different displacement volumes independently of the ratio between the angles of slope;

to provide the construction of the movable plates with a displacement volume that is smaller in backward than in forward direction, and not limited to an embodiment with differing angles of slope;

to provide at the same angle of slope different displacement volumes by means of different length of the slanting portion;

to limit the wear caused by the differences in height between front and rear plate portions by making the slope of the plates change in smooth curvatures between the horizontal areas of the grates;

to provide a plate with an upward slanting portion concave, at least in its rear area, and following tangentially the rear, horizontal portion of the plate;

to provide the front area of the slanting portion likewise smoothly curved, namely convexly in opposite directions.

DESCRIPTION OF THE PREFERRED EMBODIMENTS

Figure 1:
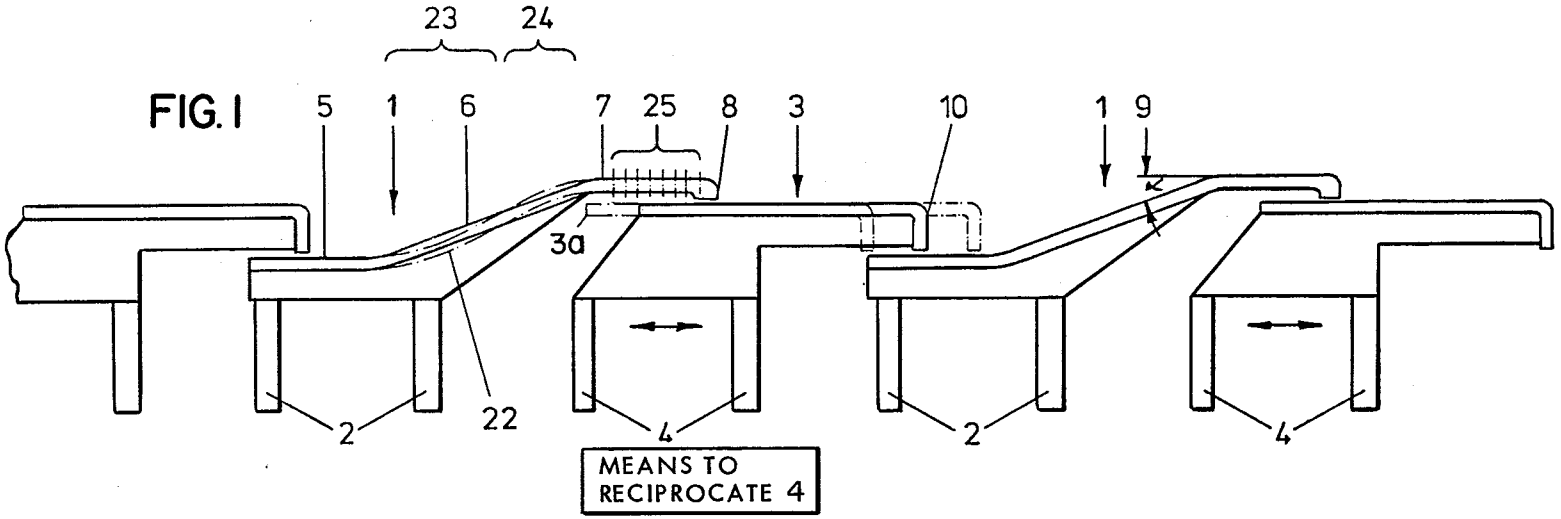
FIG. 1 is a cross-sectional side view of the device of the invention showing a sequence of grate plates of which each second one is completely level and horizontal.

As shown on FIG. 1, a plurality of fixed sets, each set having one half of a group of grate plates 1, spaced from each other are mounted each on a fixed grate plate support 2 in linear alignment. Alternatingly with these fixed sets is interposed to plurality of movable sets of grates, each set having the other half of grate plates 3, complementing the fixed sets of grate plates, and also spaced from each other in the same linear alignment as the fixed sets. The movable sets are fastened on grate plate supports 4 which are movable in forward and backward directions of their linear alignment. Each of the fixed grate plates 1 has, starting from left on FIG. 1 a rear, horizontally extending end portion 5, a central portion 6, slanting upward at an angle $\alpha$, a front portion 7 that extends again horizontally and a downwardly steeply inclined front end thrust nose 8.

The significance of the dotted lines on the central portion will be discussed hereinafter. The horizontally extending area 7 has a length covering the length of the movement of the rear edges 3*a* of the movable grate plate. The angle $\alpha$ of slope 9 is determined by the spacing between the front portion of the fixed set of grates and the rear portion of the movable set.

It is preferably preset to 20°. This angle is calculated to negotiate the sliding impetus of the material pushing upon the central sloping portion. The height of the front end portion 8 is very small.

The movable plates 3 are mounted with their rear- and front portions horizontally exactly at the same level for reciprocation in the forward direction and are spaced from the level of the fixed plates.

The front end portions of the movable set of grates curve about vertically downward into a forward thrust nose 10 having a thrust which is substantially greater than that of the set of the fixed plates. The present therefore a considerable displacement volume in the direction of forward thrust for conveying the material delivered in front of them over the steep slope 6 of the fixed plates. Since the displacement volume of the front end portions of the movable plates in the direction of their rearward movement equals zero, the small height of the front end portion of the fixed plate, as well as the friction of the material on the fixed plate suffice to prevent an undesirable backward movement of the material. The extreme front and rear positions of the rear end 3*a* of the movable set relative to the front end of the fixed set are indicated in dot and dash lines in FIG. 1.

Figure 2:
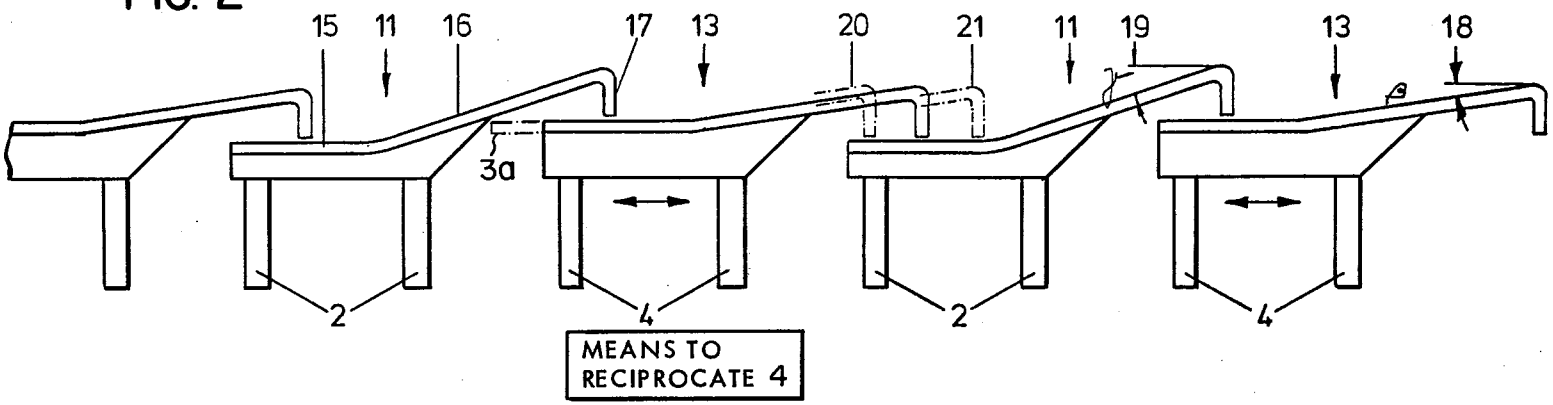
FIG. 2 is a cross-sectional side view similar to that of FIG. 1 showing a sequence of grate plates, each having a slanting portion in front with fronts of the same height.

In a similar embodiment depicted on FIG. 2 and presented by way of example, there are shown fixed grate plate supports 2 of fixed plates 11 and movable supports 4 of movable grate plates 13. Contrary to the embodiment of FIG. 1, however, each grate plate has besides a rear, horizontally extending portion 15 only a frontal, upwardly extending slanting portion 16, which ends in front in an approximately vertical frontal forward thrust nose surface 17. This forward thrust nose extends downwardly to and over the horizontal rear portion of the following fixed plate.

In this embodiment, the height of the front forward thrust nose is the same in both, the fixed and the reciprocating grate plate groups.

The rear portions 15 thereof, however, are located spaced from each other at two alternating levels. Thus at the same length of plates different angles of slope $\beta$ 18 and $\gamma$ 19 result for the front portions of the two sets of plates. These angles preferably amount for the movable plates 13 to approximately $62 = 8°$, and for the fixed plates 11 to approximately $\gamma = 17°$. With relation to the movable plate the extreme rear and front positions 20 and 21 thereof, respectively, are indicated in dot and dash lines. At the forward thrust from the position 20 into the position 21, the forward thrust nose surface 17 of this plate compacts the material layer deposited in front thereof on the following fixed plate and pushes it partly forward over and upon the slope of the following plate located in front. The displacement volume at the forward movement of the thrust nose is determined by the length of the path of movement between the positions 20 and 21 and the height of the front nose surface 17.

During the backward movement of the movable plate, the latter tends to push a portion of the material back again. The displacement volume at the backward movement, however, is smaller than that of the forward movement. While the lift is the same the effective height of the nose is smaller since only the difference in the height of the two levels between the rear portion 15 and the highest point of the front portion 16 are involved. Due to the difference between the angles $\beta$ and $\gamma$ and the spaced levels of the rear ends of the two plates the same effect results. At the forward thrust against the steeper slope of the fixed grate plate the effective surface of the front nose 17 is about vertical, while at the backward thrust the effective surface of the slanting front portion is only very slightly inclined. The smaller the angle of slope, the smaller is the capacity of the slope surface to carry along the material resting thereon in backward direction.

FIG. 1 shows in dot and dash lines at 22 how the inclination of the fixed plates 2 can be smoothed over by a curved cross-sectional shape. In the rear area 23 of the rising portion, the plate surface is smoothly curved in a concave manner, in which structure the line of curvature joins the horizontal rear plate portion 5 tangentially, while the front area 24 is curved in a convex manner. Any sudden change of direction, especially in the direction of ascent, is avoided. The total length of the slope or the maximum ascent need therefore not be substantially increased. In the convexly curved area 24 a smaller radius of curvature can be selected than in the concavely curved area 23. The two areas join suitably in a tangential manner and without a rectilinear intermediate area.

The vertical dot and dash lines 25 in a plate 1 of FIG. 1 indicate that all air passage openings of this plate should be located in the front section of this plate. This section covers intermittently at least temporarily the plate 3 located in front of this section. This is to assure that this front plate portion, which is thermally unfavorably situated, is sufficiently cooled. The invention is the result not only of an inventive genius but also of careful studies and test.

The reasons for the success of the devices of the invention can be found partly in that the material back thrust which is produced by the grate plates with a smaller angle of slope is strongly reduced. Moreover, it is of importance that the volume of displacement of the movable plates can thus be made smaller at their back movement than at their forward movement. A further explanation may be found in the fact that for one half of the grate plates the resistance to thrust is diminished by the diminution of the slope, located in front of the said grate plates, of the other grate plate group, while the resistance to thrust is not increased for this other group to the same extent by the corresponding increase of the other angel of slope.

What is claimed is:

1. A thrust grate, particularly a cooling or a fire grate, comprising, a horizontally disposed sequence of overlapping grate plates which are alternatingly fixed and movable forward and backward, each said plates having a rear portion extending parallel to the direction of movement of the said movable grate plates, an at least partially upward slanting front portion on each of said grate plates terminating in a downwardly inclined front end thrust nose, means to move the said movable grate plates essentially in a horizontal direction. The angle of the front portion of the said fixed grate plate being greater than the angle of slope of the front portion of the said movable grate plate whereby the displacement of materials on the said thrust grate will be smaller on the backward movement of said movable grate plate than at the forward movement thereof.

2. A thrust grate as claimed in claim 1, the rear portions of the plates with a smaller angle of slope being positioned at a higher level than the rear portions of the plates with the larger angle of slope.

3. A thrust grate as claimed in claim 1, the smaller angle of slope being below 12°.

4. A thrust grate as claimed in claim 1, the smaller angle of slope being between 0° and 5°.

5. A thrust grate as claimed in claim 1, the larger angle of slope being between above 12°, and particularly over 15°.

6. A thrust grate as claimed in claim 1, the front thrust height of the two grate plate types being approximately the same.

7. A thrust grate as claimed in claim 1, the front thrust height of the plates with the smaller angle of slope being greater.

8. A thrust grate as claimed in claim 1, comprising: the movable grate plates having means to provide a displacement volume at their backward movement smaller than at the forward movement.

9. A thrust grate as claimed in claim 1, at least the rear area of the upward slanting front portion of the fixed grate plates being concave and joining tangentially the rear portion of the fixed grate plates.

10. A thrust grate as claimed in claim 1, the upward slanting portion of the fixed grate plates having a concave rear area and a convex front area, which areas tangentially pass over into each other and into the adjacent plate portions.

* * * * *